US009892638B2

(12) United States Patent
Broers et al.

(10) Patent No.: US 9,892,638 B2
(45) Date of Patent: Feb. 13, 2018

(54) LIGHTING UNIT, FIXTURE AND NEWTORK

(71) Applicant: PHILIPS LIGHTING HOLDING B.V., Eindhoven (NL)

(72) Inventors: Harry Broers, S-Hertogenbosch (NL); Ruben Rajagopalan, Neuss (DE); Roger Peter Anna Delnoij, Lommel (BE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/109,589

(22) PCT Filed: Dec. 31, 2014

(86) PCT No.: PCT/EP2014/079491

§ 371 (c)(1),
(2) Date: Jul. 1, 2016

(87) PCT Pub. No.: WO2015/101647

PCT Pub. Date: Jul. 9, 2015

(65) Prior Publication Data

US 2016/0328960 A1 Nov. 10, 2016

(30) Foreign Application Priority Data

Jan. 2, 2014 (EP) ..... 14150046

(51) Int. Cl.
*G08G 1/065* (2006.01)
*G08G 1/042* (2006.01)
(Continued)

(52) U.S. Cl.
CPC ..... *G08G 1/042* (2013.01); *F21V 23/0442* (2013.01); *G08G 1/0116* (2013.01);
(Continued)

(58) Field of Classification Search
None
See application file for complete search history.

(56) References Cited

U.S. PATENT DOCUMENTS 5,479,159 A * 12/1995 Kelly ..... H02J 13/0089 315/119
5,764,163 A * 6/1998 Waldman ..... G08G 1/04 340/555

(Continued)

FOREIGN PATENT DOCUMENTS

CN 201181522 Y 1/2009
DE 102007007031 A1 8/2007

(Continued)

OTHER PUBLICATIONS

Caruso, Michael J., et al., "Vehicle Detection and Compass Applications Using AMR Magnetic Sensors," Proceedings of Sensors Expo, May 1999 (13 Pages).

(Continued)

*Primary Examiner* — Curtis King
(74) *Attorney, Agent, or Firm* — Meenakshy Chakravorty

(57) ABSTRACT

A lighting unit (110) for an outdoor lighting fixture comprises a magnetic sensor module (215). The lighting unit (110) further comprises a controller (210) coupled to the sensor module (215). The controller (210) is configured to use the sensor module (215) to determine a measurement of vehicle traffic within a region defined by a sensing range of the sensor module (215), and use the sensor module (215) to determine a current orientation of the lighting unit.

15 Claims, 5 Drawing Sheets

(51) Int. Cl.

| | |
|---|---|
| ***G08G 1/01*** | (2006.01) |
| ***G08G 1/048*** | (2006.01) |
| ***G08G 1/056*** | (2006.01) |
| ***F21V 23/04*** | (2006.01) |
| *F21V 21/15* | (2006.01) |
| *F21W 131/103* | (2006.01) |

(52) U.S. Cl.
CPC ..... *G08G 1/0133* (2013.01); *G08G 1/048* (2013.01); *G08G 1/056* (2013.01); *F21V 21/15* (2013.01); *F21W 2131/103* (2013.01); *G08G 1/065* (2013.01)

(56) References Cited

U.S. PATENT DOCUMENTS 6,079,862 A * 6/2000 Kawashima ..... G01S 3/7864 348/169
7,769,149 B2 * 8/2010 Berkman ..... H04B 3/546 340/870.07
8,300,219 B1 * 10/2012 Gordin ..... H01Q 1/1242 356/139.01
9,629,220 B2 * 4/2017 Panopoulos ..... H05B 37/0209
2002/0014971 A1 2/2002 Ferraro
2002/0167815 A1 11/2002 Becker
2002/0180596 A1 12/2002 Mattes et al.
2004/0008517 A1 * 1/2004 Bixler ..... B60Q 3/30 362/394
2006/0267795 A1 * 11/2006 Draaijer ..... G08G 1/04 340/907
2007/0109142 A1 * 5/2007 McCollough, Jr. .... G08B 21/12 340/641
2007/0252528 A1 * 11/2007 Vermuelen ..... F21V 3/04 315/34
2007/0252725 A1 * 11/2007 Nishida ..... G08G 1/096716 340/905
2007/0257818 A1 11/2007 Aubrey et al.
2008/0143493 A1 * 6/2008 Nam ..... H05B 37/038 340/12.32
2009/0033504 A1 * 2/2009 Tsai ..... G08B 3/10 340/584
2009/0034228 A1 * 2/2009 Tsai ..... G08G 1/04 362/20
2009/0034258 A1 * 2/2009 Tsai ..... H05B 37/02 362/253
2009/0175038 A1 * 7/2009 Rooymans ..... F21K 9/00 362/249.02
2009/0231852 A1 9/2009 Vinter et al.
2010/0124059 A1 * 5/2010 Duffy ..... F21K 9/65 362/249.03
2010/0127696 A1 5/2010 Huber et al.
2011/0001626 A1 * 1/2011 Yip ..... H05B 37/0263 340/635
2011/0002132 A1 * 1/2011 Park ..... F21V 21/15 362/429
2011/0204885 A1 8/2011 Le Goff et al.
2012/0014101 A1 * 1/2012 Rami ..... F21K 9/00 362/249.02
2012/0019149 A1 * 1/2012 Shih ..... H05B 37/0227 315/149
2012/0057340 A1 * 3/2012 Rami ..... F21S 8/086 362/231
2012/0206051 A1 * 8/2012 Nieuwlands ..... H05B 37/0227 315/153
2013/0063282 A1 * 3/2013 Baldwin ..... B61L 29/282 340/941
2013/0329439 A1 * 12/2013 Hellkamp ..... F21V 23/003 362/464
2014/0125250 A1 * 5/2014 Wilbur ..... H01Q 1/2291 315/297
2014/0176347 A1 * 6/2014 Kim ..... G08G 1/096716 340/907
2015/0035437 A1 * 2/2015 Panopoulos ..... F21V 14/02 315/112
2015/0145698 A1 * 5/2015 Werner ..... H05B 37/0218 340/928
2015/0173159 A1 * 6/2015 Lin ..... G01W 1/00 315/120
2016/0286627 A1 * 9/2016 Chen ..... H05B 37/0245
2017/0011522 A1 * 1/2017 Rajagopalan ..... G01B 11/002

FOREIGN PATENT DOCUMENTS

EP 2271184 A1 5/2011
GB 2444734 A 6/2008
JP 2004147374 A 5/2004

OTHER PUBLICATIONS

Cheung, Sing Yiu, et al., "Traffic Surveillance With Wireless Magnetic Sensors," University of California, Berkeley, 2007 (13 Pages).

* cited by examiner

LIGHTING UNIT, FIXTURE AND NEWTORK

CROSS-REFERENCE TO PRIOR APPLICATIONS

This application is the U.S. National Phase application under 35 U.S.C. § 371 of International Application No. PCT/EP2014/079491, filed on Dec. 31, 2014, which claims the benefit of European Patent Application No. 14150046.2, filed on Jan. 2, 2014. These applications are hereby incorporated by reference herein.

FIELD OF THE INVENTION

The present disclosure relates generally to lighting units, and in particular to lighting units which comprise or are connected to one or more sensor modules. The present disclosure relates also to outdoor lighting fixtures comprising such lighting units, and to networks of such outdoor lighting fixtures.

BACKGROUND OF THE INVENTION

Various "intelligent" outdoor lighting networks have been proposed in recent years. Such outdoor lighting networks may be "intelligent" in the sense that, e.g., they can adapt to changes in vehicle traffic density and/or to changes in weather conditions. For instance, such outdoor lighting networks may be configured to dim-down outdoor lighting fixtures thereof at times when vehicle traffic density is very low, in order to save energy. Or such outdoor lighting networks may be configured to dim-up outdoor lighting fixtures thereof in areas where weather conditions are hazardous, in order to improve road safety.

Adding such "intelligence" to outdoor lighting networks typically involves at least one of: an increased bill of materials (BOM) for each lighting fixture; increased infrastructure costs; and increased installation/configuration costs.

SUMMARY OF THE INVENTION

One aspect of the present disclosure provides a lighting unit for an outdoor lighting fixture. The lighting unit comprises: a magnetic sensor module, such as anisotropic magnetoresistance sensor module; and a controller coupled to the sensor module. The controller is configured to: use the sensor module to determine a measurement of vehicle traffic within a region defined by a sensing range of the sensor module, and use the sensor module to determine a current orientation of the lighting unit.

The inventors realized that there are advantages to using the anisotropic magnetoresistance (AMR) sensor module to determine a measurement of vehicle traffic instead of using a more commonly-used sensor such as, say, an image sensor (reference is made, for example, to the Philips LumiMotion sensor). Of course AMR sensors tend to be relatively low cost, meaning their use can result in a reduced BOM. The inventors have realized that AMR sensors can also be used to determine a current orientation of the lighting unit, and, therefore, can be reused for additional applications, potentially further reducing the BOM by obviating the need for one or more additional sensors.

The measurement of vehicle traffic may comprise one or more of: a direction-of-travel measurement, e.g. indicated with respect to North; a traffic density measurement, e.g. indicated in terms of number vehicles per hour; and an estimated type of vehicle, e.g. car or bicycle; and an estimated size of vehicle.

In various embodiments, the lighting unit may further comprise a transmitter for communicating with a controller of an outdoor lighting network, wherein the lighting unit controller is further configured to use the transmitter to transmit an indication of said current orientation to the network controller during a pre-operational phase of the lighting unit. Thus, advantageously, the various embodiments can enable an additional "auto-commissioning" functionality that may provide savings in installation/configuration costs. This is because manually determining and noting an orientation of a lighting unit, i.e. by an installer or other technical personnel, tends to be time consuming, rather complicated and, therefore, expensive.

In various embodiments, the lighting unit may comprise a transmitter for communicating with a controller of an outdoor lighting network, and may be further configured to, during an operational phase of the lighting unit: determine a magnitude of change in said current orientation; and use the transmitter to transmit an indication of a fault to the network controller in response to determining that the magnitude of change exceeds a threshold. Thus, advantageously, claimed embodiments may provide further BOM savings and/or additional functionality by reusing one sensor for a further application, namely determining that a fault has occurred, e.g. that a lighting fixture has fallen over due to bad weather or has been knocked or by a vehicle.

In various embodiments, the controller of the lighting unit may be further configured to dim-down a light output of the lighting unit in response to determining that the measurement of vehicle traffic indicates that vehicle traffic density is below a threshold. Thus, advantageously, claimed embodiments may enable energy savings by tailoring the lighting unit's light output to real-time local requirements. It will be appreciated that in various embodiments the lighting unit is able dim-down autonomously, i.e. without requiring a centralized controller.

In various embodiments, the controller of the lighting unit may be configured to take said orientation into account when determining the measurement of vehicle traffic. For instance, the measurement of vehicle traffic may comprise a direction-of-travel measurement. The controller may be configured to determine one or more expected directions of traffic based on the orientation in conjunction with stored information about a physical layout of a road (or road network) in the vicinity of the lighting unit. The expected direction(s) may be used to interpret sensor measurements in order to more accurately determine the direction-of-travel measurement.

In various embodiments, said measurement of vehicle traffic may comprise a direction-of-travel measurement, and the direction-of-travel measurement is taken into account when determining the orientation. For instance, the direction-of-travel measurement may be used, in conjunction with stored information about a physical layout of a road (or road network) in the vicinity of the lighting unit, to interpret sensor measurements in order that the orientation may be determined more accurately.

In various embodiments, said current orientation may comprise, or be derived from, a measurement of yaw of the sensor module.

In various embodiments, said current orientation may comprise, or be derived from, at least one of: a measurement of pitch of the lighting unit with respect to a predefined direction; and a measurement of roll of the lighting unit with respect to a predefined direction.

In various embodiments, the indication of said current orientation may comprise an indication of a three-axis orientation of the lighting unit.

In various embodiments, the indication of said current orientation may comprise a pitch-compensated, and/or roll-compensated, indication of a bearing of the lighting unit with respect to north.

A second aspect of the present disclosure provides an outdoor lighting fixture comprising one or more of the lighting units described above.

A third aspect of the present disclosure provides an outdoor lighting network comprising a plurality of outdoor lighting fixtures described above, and a network controller in communication with the outdoor lighting fixtures. In various embodiments, the network controller may be arranged to: receive the indication of said current orientation from at least one of the outdoor lighting fixtures; and associate the indication of said current orientation with a logical address of the at least one of the outdoor lighting fixtures.

A fourth aspect of the present disclosure provides a method of installing and commissioning the outdoor lighting network described above, the method comprising: installing the plurality of outdoor lighting fixtures at respective locations; installing the network controller; receiving, by the network controller, the respective indication of said current orientation from each of the plurality of outdoor lighting fixtures; and associating, by the network controller, the respective indication of said current orientation of each of the plurality of outdoor lighting fixtures with a respective logical address thereof.

A fifth aspect of the present disclosure provides a computer program product comprising a computer program which, when executed by a controller of a lighting unit, the controller being coupled to a magnetic sensor module, causes the lighting unit to be configured in accordance with the any of the lighting unit embodiments described above.

DETAILED DESCRIPTION OF PREFERRED EMBODIMENTS

Figure 1:
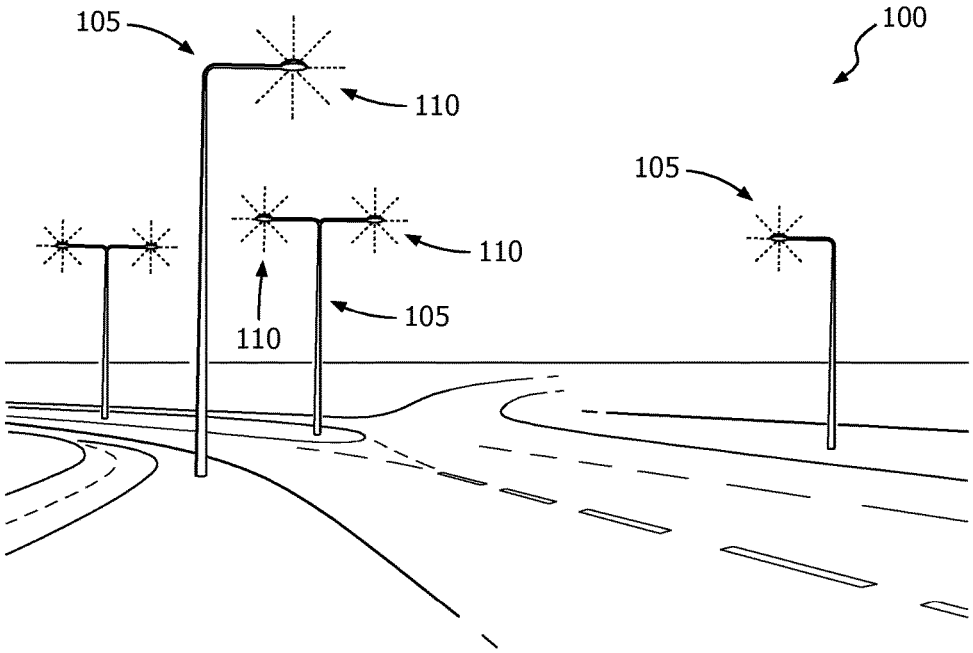
FIG. 1 depicts an external space illuminated by an outdoor lighting network in accordance with an embodiment.

Referring to FIG. 1, an outdoor lighting network 100 according to one embodiment is arranged to illuminate an outdoor space, which in this instance is part of a road network. The outdoor lighting network 100 comprises a plurality of lighting fixtures 105. The outdoor lighting network 100 further comprises a network control system (not shown in FIG. 1; ref. 235 in FIG. 2) in communication with the lighting fixtures 105.

Each of the lighting fixtures 105 comprises either one or two lighting units 110, as shown in FIG. 1. (In other embodiments, the lighting fixtures 105 may each comprise more than two lighting units 110.) Each of the lighting fixtures 105 further comprises a vertical pole which is secured to the ground and which is arranged to support the lighting unit(s) 110 at a certain distance (e.g., three meters) above the ground.

Figure 2:
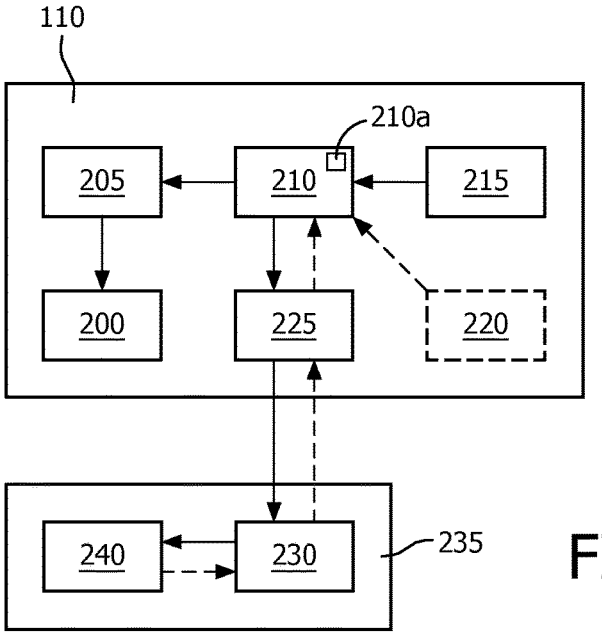
FIG. 2 schematically shows a lighting unit of the outdoor lighting network of FIG. 1 communicably coupled to a network controller of said outdoor lighting network.

Referring to FIG. 2, each of the lighting units 110 comprises one or more light sources 200, driver 205 which is connected to the light source(s) 200, and a controller 210 (hereinafter, the "lighting controller") which is connected to the driver 205. Each of the lighting units 110 further comprises a magnetic sensor module 215, which in this embodiment is an AMR sensor module 215, connected to the lighting controller 210, an optional global positioning system (GPS) module 220 (shown in dashed lines) connected to the lighting controller 210, and a transmitter 225 which is connected to the lighting controller 210. The lighting controller 210 comprises memory 210*a*. The transmitter 225 is suitable for transmitting data to a receiver 230 of the network control system 235.

The network control system 235 further comprises a controller 240 (hereinafter, the "network controller") which is connected to the receiver 230 and which is configured to receive and process data therefrom.

The transmitter 225 and the receiver 230 may be part of respective transceivers, thereby enabling two-way communication between the lighting units 110 and the network control system 235.

In various embodiments, any one or more of the light source(s) 200, the driver 205, the AMR sensor module 215, the GPS module 220 the transmitter/transceiver 225 and the receiver/transceiver 230 may be components which are known per se to those of ordinary skill in the art. Therefore these components per se will not be described in any detail herein.

A method 300 of installing and commissioning the outdoor lighting network 100 will now be described with reference to FIGS. 3*a* and 3*b*.

Figure 3A:
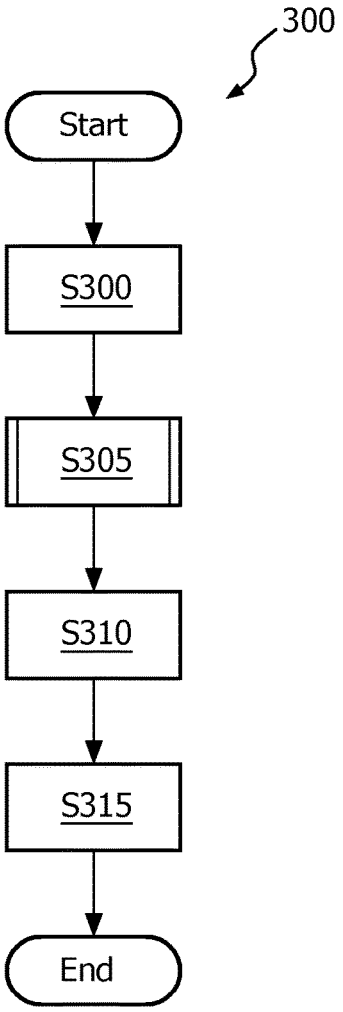
FIGS. 3*a* & 3*b* provide a schematic overview of a method installing and commissioning the outdoor lighting network of FIG. 1.

Referring to FIG. 3*a*, the method 300 comprises installing and at least partially configuring (at step S300) the network controller 240, and installing and at least partially configuring (at step S305) the lighting fixtures 105. It will be appreciated that there are various different orders in which the network controller 240 and the lighting fixtures 105 may be installed and configured. For instance, some or all of the lighting fixtures 105 may be installed before the network controller 240 is installed, and then configuration could be done in a separate, later phase.

Figure 3B:
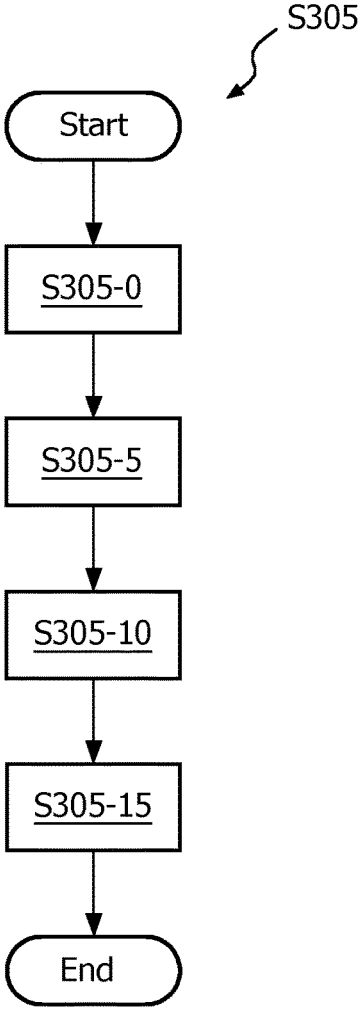

Referring now to FIG. 3*b*, installing and at least partially configuring each of the lighting fixtures 105 (i.e., step S305) comprises the following sub-steps.

First, the lighting controller 210 activates the AMR sensor module 215 (at sub-step S305-0).

After activation, the AMR sensor module 215 measures the earth's magnetic field (at sub-step S305-05). The measurement(s) may be stored in a memory (not shown) of the AMR sensor module 215. The measurement(s) may be stored in the memory 210*a* of the lighting controller 210.

Then the lighting controller 210 uses the AMR sensor module 215 to determine a current orientation of the lighting unit 110 (at sub-step S305-10), based on the measurement(s) obtained during sub-step S305-05. Specifically, the AMR sensor module 215 determines its own current orientation, which the lighting controller 210 converts into the current orientation of the lighting unit 110 based on the orientation of the AMR sensor module 215 relative to the lighting unit 110.

Figure 4:
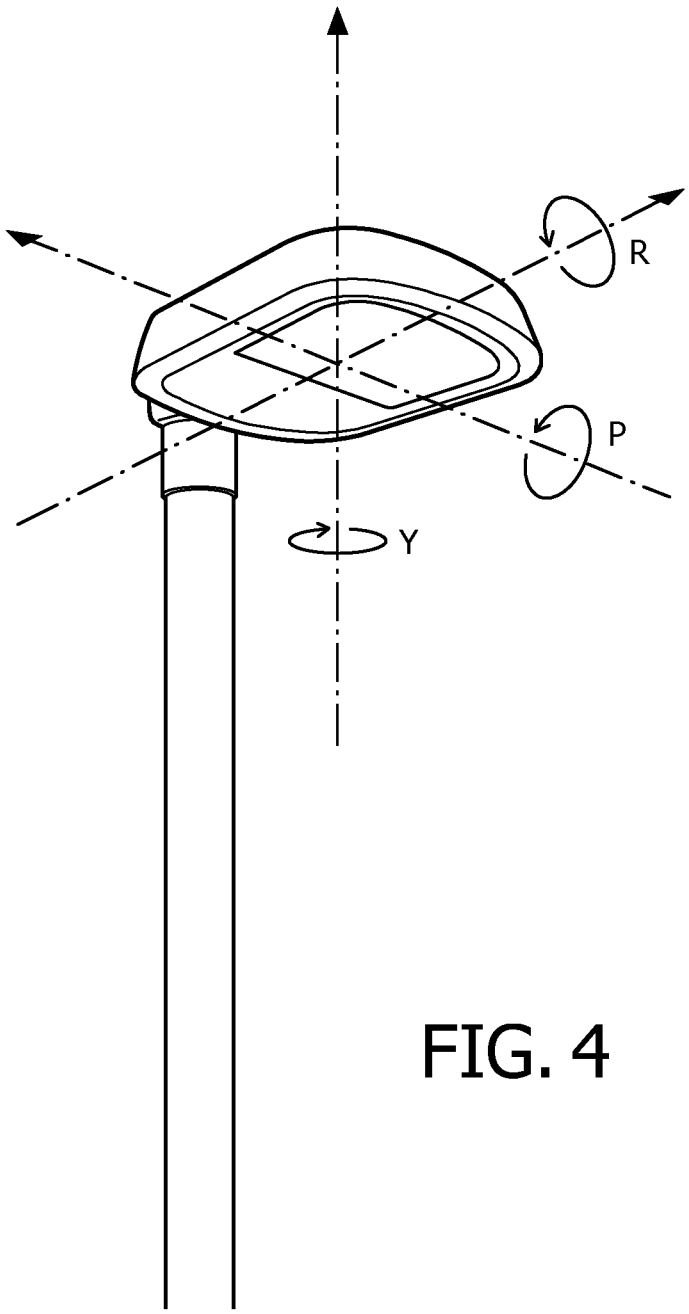
FIG. 4 is a perspective view of the lighting unit of FIGS. 1 and 2, indicating respective pitch, roll and yaw axes of the lighting unit.

The AMR sensor module 215 determines its own current orientation in a conventional manner. Referring briefly to FIG. 4, its current orientation may comprise, or be derived from, a measurement of yaw of the AMR sensor module 215. For instance, the measurement of yaw may comprise a bearing of the AMR sensor module 215 with respect to magnetic north. Various embodiments may be arranged to derive a measurement of yaw (Y) of the lighting unit 110 from the measurement of yaw of the AMR sensor module 215. The current orientation may additionally comprise a measurement of pitch (P) of the lighting unit 110 with respect to a predefined direction and/or a measurement of roll (R) of the lighting unit 110 with respect to a predefined direction.

Referring back to FIG. 3*b*, the lighting controller 210 completes step S305 by sending an indication of current orientation to the network controller 240 (at sub-step S305-15). As will be appreciated from the two immediately-preceding paragraphs, the indication of current orientation may indicate a three-axis orientation of the lighting unit 110. Alternatively, the indication of said current orientation may comprise a pitch-compensated and/or roll-compensated indication of a bearing of the lighting unit 110 with respect to magnetic north. In embodiments where the lighting unit 110 comprises the GPS unit 220, the lighting controller 210 may also send an indication of current location (at step S305), comprising GPS coordinates indicative of where the lighting unit 110 is located.

Referring again to FIG. 3*a*, the method 300 further comprises receiving, by the network controller 240 (at step S310), respective orientation information from each of the lighting fixtures 105. The orientation information from each of the lighting fixtures 105 comprises the indication of current orientation (sent at sub-step S305-15). In embodiments where the lighting unit 110 comprises the GPS unit 220, the network controller 240 may also receive (at step S310), respective location information from each of the lighting fixtures 105; the location information from each of the lighting fixtures 105 comprises the indication of current location (sent at sub-step S305-15).

The method 300 further comprises associating, by the network controller 240 (at step S315), the orientation information with respective identifiers of the lighting fixture 105. For instance, the network controller 240 may enter the orientation information and matching identifiers in a look-up table stored in a memory (not shown) of the network controller 240. Following step S315, the method 300 ends.

Advantageously, the network controller 240 can use the orientation information to distinguish between two or more lighting units 110 which are located near each other, e.g. two or more lighting units 110 from the same lighting fixture 105 (whose GPS coordinates would therefore be very similar). With regard to twin-lighting-unit lighting fixtures 105 of the type shown in FIG. 1, for example, respective yaw measurements from the two lighting units 110 of a given lighting fixture 105 would be substantially 180 degrees apart. For instance, the network controller 240 could determine that an east-facing lighting unit 110 and a west-facing lighting unit 110 are both comprised in a given lighting fixture 105 because they have similar GPS coordinates (the given lighting fixture 105 would be identifiable from the GPS coordinates). The network controller 240 could also determine, from a lighting plan showing where the given lighting fixture 105 is located with respect to a road network, that the west-facing lighting unit 110 is the one which is arranged to illuminate a road's southbound lane, whereas the east-facing lighting unit 110 is the one which is arranged to illuminate the corresponding northbound lane. Thus the orientation information, particularly in combination with the location information, may enable "automatic commissioning" of the lighting network 100.

Also, in various embodiments the lighting units 110 can be mounted at different orientations with respect to their respective lighting fixtures 105. In such embodiments, the orientation information may be used to determine whether a given lighting unit 110 had been mounted in accordance with an intended orientation for that lighting unit 110, e.g. as defined in a lighting plan.

After all of the lighting fixture 105 have been installed and configured (at least partially), and the orientation information has been associated with the respective identifiers of the lighting fixture 105 at the network controller 240, a "pre-operational" phase of the outdoor lighting network 100 is complete and an "operational phase" can begin. Some optional operational-phase behaviors of the outdoor lighting network 100 will now be described.

Figure 5:
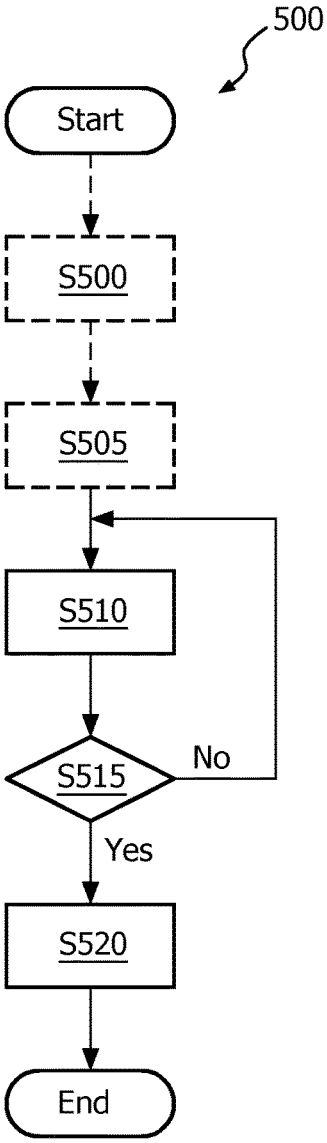
FIG. 5 is a flowchart which summarizes a method of using a sensor module of the lighting unit of FIG. 2 to determine a measurement of vehicle traffic.

Referring to FIG. 5, a method 500 of using the AMR sensor module 215 to determine a measurement of vehicle traffic density will now be described. It will be appreciated that the measurement will be representative of vehicle traffic density within a region (hereinafter, the "sensing region") defined by a sensing range of the AMR sensor module 215, which range may be e.g. between four and twelve meters.

First (at step S500), optionally the lighting controller 210 uses the AMR sensor module 215 to measure the earth's magnetic field over a predetermined period of time.

Next (at step S505), optionally the lighting controller 210 identifies changes in the magnetic field measurements collected during step S500, and performs a statistical analysis on these changes to thereby determine one or more properties of the environment within the sensing region. For instance, the lighting controller 210 may determine that the changes were caused by vehicles passing through the sensing region and, therefore, that a lane of a road (or a part thereof) extends through the sensing region, along with the general direction in which it extends through the sensing region. As part of this optional step, the lighting controller 210 stores the one or more properties that it determined, for later use in determining the measurement of vehicle traffic density.

Next, the lighting controller 210 uses the AMR sensor module 215 to take a plurality of measurements of the earth's magnetic field (at step S510), and then determines whether there is a change in the magnetic field measurements which exceeds a predetermined "vehicle threshold" (at step S515). The vehicle threshold can be obtained through routine experimentation based on at least one of: the type of sensor being used; the position at which the sensor is mounted; and the type of traffic that is to be monitored.

If there is no change in the magnetic field measurements which exceeds the predetermined vehicle threshold, the lighting controller repeats steps S510 and S515.

If there is a change in the magnetic field measurements which exceeds the predetermined vehicle threshold, the lighting controller 210 determines (at step S520) that a vehicle passed through the sensing region. The lighting controller 210 may then store relevant information in its memory 210*a* (or elsewhere), such as the time the vehicle passed through the sensing region, the direction in which the vehicle was travelling etc.

The method 500 may be performed repeatedly in order to determine, over time, the measurement of vehicle traffic density.

Figure 6:
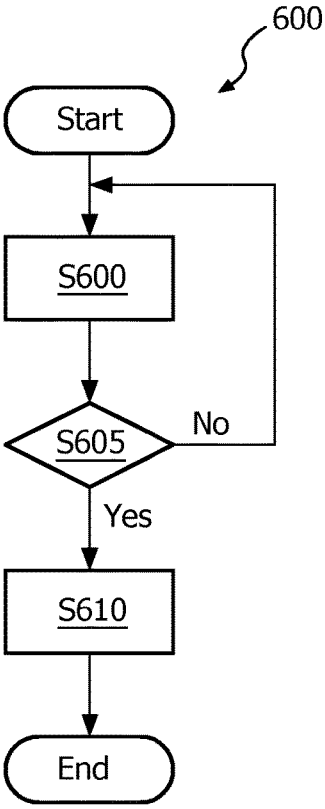
FIG. 6 is a flowchart which summarizes a method of indicating, by a lighting fixture of the outdoor lighting network of FIG. 1, to a controller of the outdoor lighting network, that the lighting fixture has experienced a fault.

Referring to FIG. 6, a method 600 of indication a fault to the network controller 240 will now be described.

First (at step S600), the lighting controller 210 uses the AMR sensor module 215 to take a plurality of measurements of the earth's magnetic field. This step might have been performed as part of another method or process, e.g. the above-described method 500 of using the AMR sensor module 215 to determine a measurement of vehicle traffic density.

Next (at step S605), the lighting controller 210 determines whether there is a change in the magnetic field measurements which exceeds a predetermined "fault threshold" (at step S515). The fault threshold can be obtained through routine experimentation based on at least one of: the type of sensor being used; the position at which the sensor is mounted; and the manner in which the sensor has been mounted, e.g. on a pole which is expected to "swing" to a certain extent in some weather conditions (such as strong winds).

If there is no change in the magnetic field measurements which exceeds the predetermined fault threshold, the lighting controller repeats steps S600 and S605.

If there is a change in the magnetic field measurements which exceeds the predetermined fault threshold, the lighting controller 210 determines (at step S610) that a fault has occurred, e.g. that the lighting fixture 105 has fallen over or has been knocked over. The lighting controller 210 may then transmit an indication of the fault to the network controller 240.

The method 600 may be performed continually in order to detect the fault soon after it has occurred.

The methods 300, 500, 600 described above may, for example, be carried out by one or more general purpose processors executing a suitable computer program, as will be appreciated by those of ordinary skill in the art.

Figure 7:
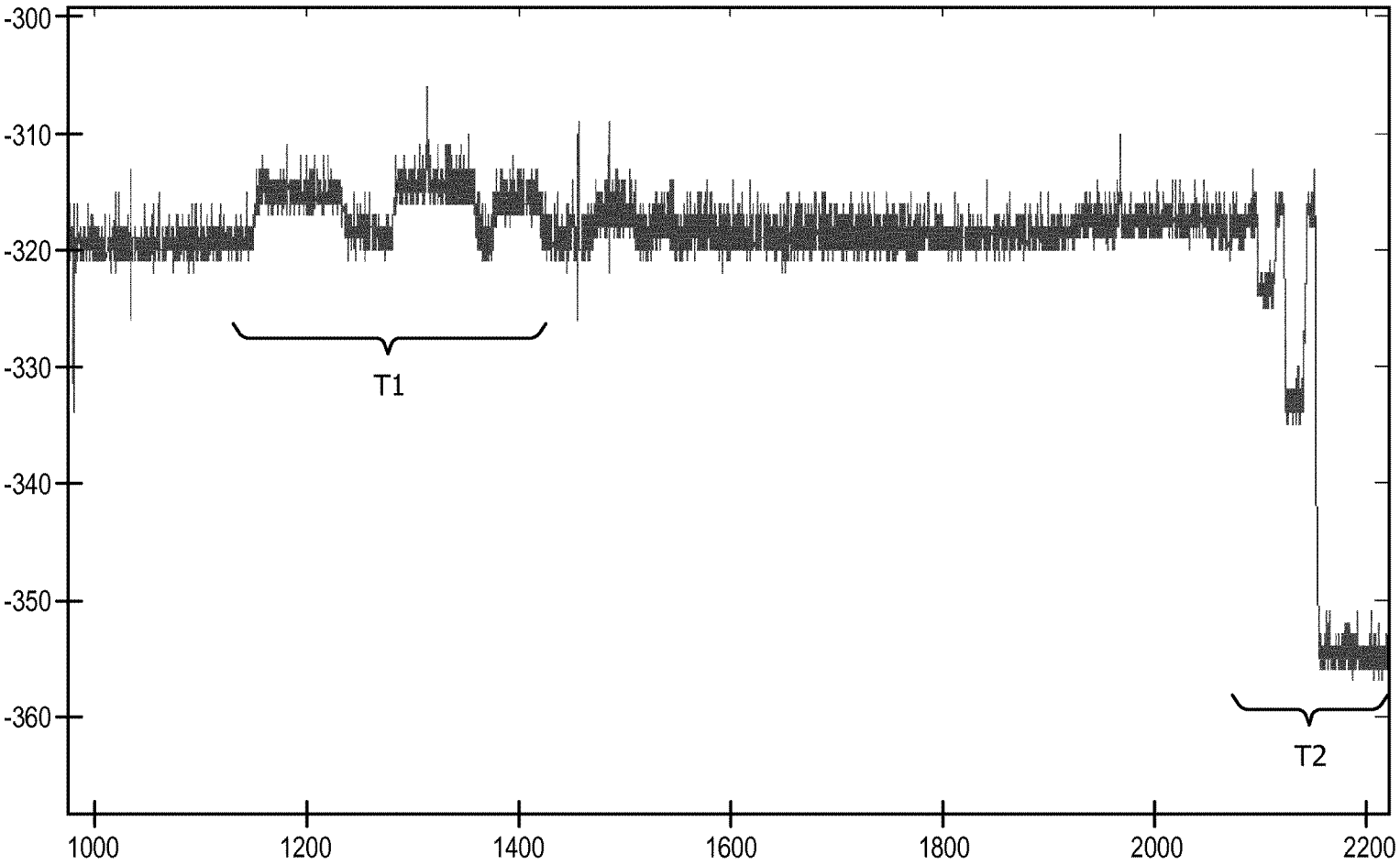
FIG. 7 shows an example of the response of the sensor module of the lighting unit of FIG. 2 to vehicles in a sensing region of the sensor module.

For information, and a better understanding of the foregoing description, FIG. 7 shows empirical measurements obtained by the AMR sensor module 215 according to one embodiment; the vertical axis represents the magnitude of response of the AMR sensor module 215, and the horizontal axis represents time. As shown in FIG. 7, a car travelling through the sensing region of the AMR sensor module 215 during time T1 causes a change in the magnetic field measurements which exceeds the predetermined vehicle threshold, and so the lighting controller 210 determines that a vehicle passed through the sensing region. Also as shown in FIG. 7, a van travelling into the sensing region of the AMR sensor module 215 during time T2 causes a larger change in the magnetic field measurements, which exceeds the predetermined vehicle threshold, and so the lighting controller 210 determines that a larger vehicle entered through the sensing region.

The foregoing description was given by way of example only. Those of ordinary skill in the art will appreciate numerous modifications and alternative embodiments which fall within the scope of the claims herein. For example, it will be appreciated that in various embodiments the steps S515 and S520 may (at least in part) be performed by the network controller 240; i.e. the lighting units 110 may take the sensor measurements and forward them to the network controller 240 to process in order to determine a measure of vehicle traffic density. Similar comments apply to steps S605 and S610.

The foregoing description discusses the AMR sensor module 200. The term "sensor module" is used herein to refer to an apparatus including one or more sensors of same or different types; the AMR sensor module 200 comprises at least one AMR sensor. A given sensor module unit may have any one of a variety of mounting arrangements for the sensor(s), enclosure/housing arrangements and shapes, and/or electrical and mechanical connection configurations. Additionally, a given sensor module optionally may be associated with (e.g., include, be coupled to and/or packaged together with) various other components (e.g., control circuitry) relating to the operation of the sensor(s).

The foregoing description discusses the light source(s) 200. The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radio luminescent sources, and luminescent polymers.

The foregoing description discusses the light unit 110. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s).

The foregoing description discusses the lighting fixture 110. The term "lighting fixture" is used herein to refer to an implementation or arrangement of one or more lighting units in a particular form factor, assembly, or package.

The foregoing description discusses the lighting controller 210 and the network controller 240. The term "controller" is used herein generally to describe various apparatus relating to the operation of one or more light sources or other devices. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs). In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein.

The terms "transmitter", "receiver" and "transceiver" are used herein in a generic sense to refer to any type of apparatus suitable for, respectively, transmitting a signal, receiving a signal and both transmitting a signal and receiving a signal.

The terms "program" or "computer program" are used herein in a generic sense to refer to any type of computer code (e.g., software or microcode) that can be employed to program one or more processors or controllers.

The foregoing description discusses the outdoor lighting network 100. The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection).

The invention is not limited to any particular method for receiving data, nor to any particular method for transmitting data.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

The invention claimed is:

1. A lighting unit for an outdoor lighting fixture, the lighting unit comprising:

an anisotropic magnetoresistance sensor module; and a controller coupled to the sensor module, the controller being configured to:

use the sensor module to determine a measurement of vehicle traffic within a region defined by a sensing range of the sensor module, and use the sensor module to determine a current orientation of the lighting unit.

2. The lighting unit of claim 1, further comprising a transmitter for communicating with a controller of an outdoor lighting network, wherein the lighting unit controller is further configured to use the transmitter to transmit an indication of said current orientation to the network controller during a pre-operational phase of the lighting unit.

3. The lighting unit of claim 1, further comprising a transmitter for communicating with a controller of an outdoor lighting network, wherein the lighting unit controller is further configured to, during an operational phase of the lighting unit:

determine a magnitude of change in said current orientation; and use the transmitter to transmit an indication of a fault to the network controller in response to determining that the magnitude of change exceeds a threshold.

4. The lighting unit of claim 1, wherein the controller is further configured to dim-down a light output of the lighting unit in response to determining that the measurement of vehicle traffic indicates that vehicle traffic density is below a threshold.

5. The lighting unit of claim 1, wherein the controller is configured to take the orientation into account when determining the measurement of vehicle traffic.

6. The lighting unit of claim 1, wherein the measurement of vehicle traffic comprises a direction-of-travel measurement, and the direction-of-travel measurement is taken into account when determining the orientation.

7. The lighting unit of claim 1, wherein said current orientation comprises, or is derived from, a measurement of yaw of the sensor module.

8. The lighting unit of claim 1, wherein said current orientation comprises, or is derived from, at least one of: a measurement of pitch of the lighting unit with respect to a predefined direction; and a measurement of roll of the lighting unit with respect to a predefined direction.

9. The lighting unit of claim 8, wherein the indication of said current orientation comprises an indication of a three-axis orientation of the lighting unit.

10. The lighting unit of claim 8, wherein the indication of said current orientation comprises a bearing of the lighting unit with respect to north.

11. An outdoor lighting fixture comprising a lighting unit, the lighting unit comprising:

an anisotropic magnetoresistance sensor module;

a controller coupled to the sensor module, the controller being configured to:

use the sensor module to determine a measurement of vehicle traffic within a region defined by a sensing range of the sensor module, and use the sensor module to determine a current orientation of the lighting unit; and a transmitter for communicating with a controller of an outdoor lighting network, wherein the lighting unit controller is further configured to use the transmitter to transmit an indication of said current orientation to the network controller during a pre-operational phase of the lighting unit.

12. An outdoor lighting network comprising a plurality of outdoor lighting fixtures according to claim 11, and a network controller in communication with the outdoor lighting fixtures.

13. The outdoor lighting network of claim 12, wherein the network controller is arranged to:

receive the indication of said current orientation from at least one of the outdoor lighting fixtures; and associate the indication of said current orientation with a logical address of the at least one of the outdoor lighting fixtures.

14. A method of installing and commissioning an outdoor lighting network, the method comprising:

installing a plurality of outdoor lighting fixtures at respective locations;

installing a network controller in communication with the plurality of outdoor lighting fixtures;

receiving, by the network controller, a respective indication of a current orientation from each of the plurality of outdoor lighting fixtures, the current orientation having been determined by an anisotropic magnetoresistance sensor module; and associating, by the network controller, the respective indication of said current orientation of each of the plurality of outdoor lighting fixtures with a respective logical address thereof.

15. A non-transitory computer-readable storage medium storing a computer program comprising software code which, when executed by a controller of a lighting unit, the controller being coupled to a magnetic sensor module, causes the lighting unit to be configured in accordance with claim 1.

* * * * *